US006779604B2

(12) United States Patent
Biegler et al.

(10) Patent No.: US 6,779,604 B2
(45) Date of Patent: Aug. 24, 2004

(54) DEFORMABLE GRAVEL PACK AND METHOD OF FORMING

(75) Inventors: Mark W. Biegler, Houston, TX (US); John W. Mohr, Missouri City, TX (US); Roger A. Frederickson, Meraux, LA (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/862,795

(22) Filed: May 21, 2001

(65) Prior Publication Data

US 2002/0011334 A1 Jan. 31, 2002

Related U.S. Application Data

(60) Provisional application No. 60/209,419, filed on Jun. 5, 2000, and provisional application No. 60/211,398, filed on Jun. 14, 2000.

(51) Int. Cl.[7] ..... E21B 43/04
(52) U.S. Cl. ..... 166/278; 166/228
(58) Field of Search ..... 166/278, 280, 166/276, 51, 228, 310

(56) References Cited

U.S. PATENT DOCUMENTS

| | | | | | |
|---|---|---|---|---|---|
| 3,481,401 | A | | 12/1969 | Graham | 166/280 |
| 3,782,466 | A | | 1/1974 | Lawson et al. | 166/254 |
| 3,953,340 | A | * | 4/1976 | Templeton et al. | 507/203 |
| 4,008,763 | A | * | 2/1977 | Lowe, Jr. | 166/253.1 |
| 4,428,427 | A | * | 1/1984 | Friedman | 166/276 |
| 4,579,668 | A | * | 4/1986 | Messenger | 166/294 |
| 4,716,964 | A | * | 1/1988 | Erbstoesser et al. | 166/284 |
| 4,796,701 | A | * | 1/1989 | Hudson et al. | 166/278 |
| 4,969,523 | A | * | 11/1990 | Martin et al. | 166/278 |
| 5,083,614 | A | | 1/1992 | Branch | 166/278 |
| 5,330,005 | A | | 7/1994 | Card et al. | 166/280 |
| 5,492,178 | A | * | 2/1996 | Nguyen et al. | 166/276 |
| 5,501,274 | A | * | 3/1996 | Nguyen et al. | 166/276 |
| 5,551,514 | A | * | 9/1996 | Nelson et al. | 166/278 |
| 5,582,249 | A | | 12/1996 | Caveny et al. | 166/276 |
| 5,697,440 | A | | 12/1997 | Weaver et al. | 166/281 |
| 6,059,034 | A | | 5/2000 | Rickards et al. | 166/280 |
| 6,172,011 | B1 | * | 1/2001 | Card et al. | 166/280 |
| 6,330,916 | B1 | * | 12/2001 | Rickards et al. | 166/280 |
| 6,372,678 | B1 | * | 4/2002 | Youngman et al. | 166/280 |
| 6,390,195 | B1 | * | 5/2002 | Nguyen et al. | 166/276 |
| 6,439,309 | B1 | * | 8/2002 | Matherly et al. | 166/276 |

FOREIGN PATENT DOCUMENTS

| | | | |
|---|---|---|---|
| EP | 1001133 A1 | 5/2000 | E21B/43/26 |
| GB | 2319796 A | 6/1988 | E21B/43/267 |

OTHER PUBLICATIONS

Rickards, Allan et al. "Need Stress Relief? A New Approach to Reducing Stress Cycling Induced Proppant Pack Failure", SPE 49247, Sep. 1998, pp. 659–673.

Stephenson, Chris et al. "Increased Resistance to Proppant Flowback By Adding Deformable Particles To Proppant Packs Tested In The Laboratory", SPE 56593, Oct. 1999, pp. 427–438.

(List continued on next page.)

*Primary Examiner*—David Bagnell
*Assistant Examiner*—Thomas S Bomar
(74) *Attorney, Agent, or Firm*—Denise Y. Wolfs; Gary P. Katz

(57) ABSTRACT

A gravel pack is formed using a mixture of a solid deformable material and conventional gravel pack gravel. In the event of reservoir compaction, such a gravel pack will reduce the transmission of forces from the subterranean formation to the wellbore completion hardware, thereby significantly extending the life of a well. Deformable materials selected for mixing with conventional gravel may be elastically flexible, plastically deformable, or crushable solid materials or particles.

20 Claims, 3 Drawing Sheets

OTHER PUBLICATIONS

"Recommended Practices For Testing Sand Used In Hydraulic Fracturing Operations", American Petroleum Institute, Recommended Practice 56, Dec. 1995.

"Recommended Practices For Testing Sand Used In Gravel Packing Operations", American Petroleum Institute, Recommended Practice 58, Dec. 1995.

"Recommended Practices For Evaluating Short Term Proppant Pack Conductivity", American Petroleum Institute, Recommended Practice 61, Dec. 1989.

Hamilton, J.M., et al., "Subsidence–Induced Shear Failures Above Oil and Gas Reservoirs," Rock Mechanics, Balkema, Rotterdam, 1999, pp. 273–282.

Bruno, M.S., "Subsidence–Induced Well Failure," SPE 20058, 1990, pp. 383–390.

Dale, B.A., et al., "A Case History of Reservoir Subsidence and Wellbore Damage Management in the South Belridge Diatomite Field," SPE 35658, 1996, pp. 101–113.

Fredrich, J.T., et al., "Three–Dimensional Geomechanical Simulation of Reservoir Compaction and Implications for Well Failures in the Belridge Diatomite," SPE 36698, 1996.

Schwall, G.H., et al., "Subsidence Induced Casing Deformation Mechanisms in the Ekofisk Field," Rock Mechanics in Petroleum Engineering, Proceedings of EUROCK'94, Delft, Netherlands, Aug. 1994, pp. 507–515.

Allen, D., "Wilmington Subsidence Problems," World Oil, Aug. 1, 1959, pp. 86–88.

Schwall, G.H., et al., "Reservoir Compaction Well Design for the Ekofisk Field," SPE 36621, 1996, pp. 487–502.

Cernocky, E.P., et al., "Approach to Casing Design for Service in Compacting Reservoirs," SPE 30522, 1995, pp. 731–742.

Yudovich, A., et al., "Casing Deformation in Ekofisk," Journal of Petroleum Technology, Jul. 1989, pp. 729–734.

Anvik, H.K., et al., "Drilling and Workover Experiences in the Greater Ekofisk Area," SPE/IADC 16150, 1987, pp. 881–892.

White, J., Moore, S., Miller, M., and Faul, R.; "Foaming Cement as a Deterrent to Compaction Damage in Deepwater Production", SPE 59136, 2/23–25/00.

* cited by examiner

DEFORMABLE GRAVEL PACK AND METHOD OF FORMING

This application claims the benefit of U.S. Provisional Application No. 60/209,419 filed Jun. 5, 2000, and U.S. Provisional Application No. 60/211,398 filed Jun. 14, 2000, both of which are incorporated herein by reference.

FIELD OF THE INVENTION

This invention relates generally to the field of wellbore completions in oil and gas production operations and more specifically to the design of gravel pack completions that are better able to withstand reservoir compaction forces.

BACKGROUND OF THE INVENTION

The production of fluids from subterranean reservoir formations can lead to a reduction in reservoir pressure. In some cases, the pressure reduction results in crushing of the reservoir rock by the weight of overlying formations. This crushing of the reservoir rock and the related subsidence is sometimes referred to as reservoir compaction. The movement of subterranean formations associated with reservoir compaction can damage wellbores that intersect the deforming or moving formations. Reservoir compaction may also manifest itself as a collapse around a horizontal wellbore, which generally also damages or destroys the wellbore.

One method currently used to protect a well completion from formation movement is the creation of an annular space (or spaces) between the wellbore tubing and the surrounding subterranean formation and/or casing, to eliminate or postpone the transfer of mechanical forces (load) from a moving formation to the completion tubulars and any associated downhole equipment. Within a production interval, a fluid-filled annular space could exist in either an open-hole completion or in a cased-hole completion. The annular space allows for some formation movement to occur before force is applied to the well completion equipment. Note that in a cased-hole completion, the load is first transferred to the outer casing and then to the wellbore tubing string as the outer casing is deformed. One variation of this method is to enlarge the initial borehole with bi-center drill bits or underreaming (hole opening) operations. The enlarged borehole provides additional space for formation movement before loads are applied to the wellbore components.

In some reservoirs, particulate matter is carried into the wellbore along with the produced fluids. Such particulate matter, hereafter referred to as "sand," may result from an unconsolidated or loosely consolidated formation, from a consolidated formation with intervals of friable or unconsolidated material, or from crushing of the formation due to compaction. In such a situation, a "gravel pack" or other filtration method may be employed to avoid damaging or plugging the wellbore or production equipment with sand. In a typical gravel pack completion, a screen is positioned within the wellbore adjacent to the interval to be completed and a gravel slurry is pumped down the well and into the annulus around the screen. As liquid is lost from the slurry into the formation, gravel is deposited around the screen to form a permeable mass around the screen. The gravel is sized to allow produced fluids to flow through the gravel, and to block the flow of formation particulate material.

Since a gravel pack occupies the annular space between the completion hardware and the formation, using a fluid-filled annular space to protect the wellbore is not possible when a gravel pack is employed to prevent production of formation sand. The gravel pack will occupy the annulus between the casing and screen, allowing transmission of forces directly from the casing to the completion hardware. An enlarged borehole is also not practical when a gravel pack is being used because this borehole-by-casing annulus often must be filed with cement to allow hydraulic isolation of the producing formations or mechanical fixation of the casing. This cement provides a vehicle for transmission of load from the formation to the casing. Completion hardware includes the production tubing string, the screen used to exclude the gravel pack, and any other associated downhole equipment in the affected portion of the wellbore. The screen used to contain the gravel pack in the annulus is particularly vulnerable to damage when the gravel pack is deformed by the force of the moving formation.

Gravel pack gravel can be naturally occurring or man-made, and is typically made up of hard silica-like materials that have compressive strengths similar to or exceeding the compressive strength of the reservoir formation. The term "conventional gravel" will be used herein to indicate silica, silica-like, or ceramic particles used as a downhole filtering mechanism. The presence of the conventional gravel enables direct application of forces from the moving or collapsing formation to the wellbore completion equipment for both open-hole and cased-hole gravel pack completions. When a conventional gravel-packed completion is employed to control production of formation sand, the compacting or subsiding reservoir imparts mechanical loads (via the gravel pack gravel) to the well completion equipment, damaging that equipment and often requiring sidetracking around the damaged zone and re-drilling through the desired formation or even drilling of a replacement well.

Reservoir compaction forces transmitted through gravel packs significantly reduce the life of the completion, resulting in significant costs to recomplete or re-drill a well. Postponing, reducing, or eliminating the damage resulting from reservoir compaction would have significant economic benefits. Accordingly, there is a need for a wellbore completion methodology that will allow the wellbore to be flexible and resilient to the movement or collapse of the surrounding formation while controlling the production of formation sand.

SUMMARY OF THE INVENTION

This invention provides a method for forming a gravel pack in a wellbore penetrating a subterranean formation by using a solid deformable material in place of at least a portion of the conventional gravel to reduce the transfer of load forces from the subterranean formation to the wellbore equipment below the transfer of load forces that would occur with conventional gravel alone. The invention also provides a gravel pack, which includes a mixture of conventional gravel and a deformable material to form the gravel pack in the wellbore.

BRIEF DESCRIPTION OF THE DRAWINGS

The present invention and its advantages will be better understood by referring to the following detailed description and the attached drawings in which like numerals identify like parts and function and in which.

The drawings illustrate specific embodiments of the invention and are not intended to exclude from the scope of the invention other embodiments that are the result of normal and expected modifications of these specific embodiments.

DETAILED DESCRIPTION OF THE INVENTION

Figure 1:
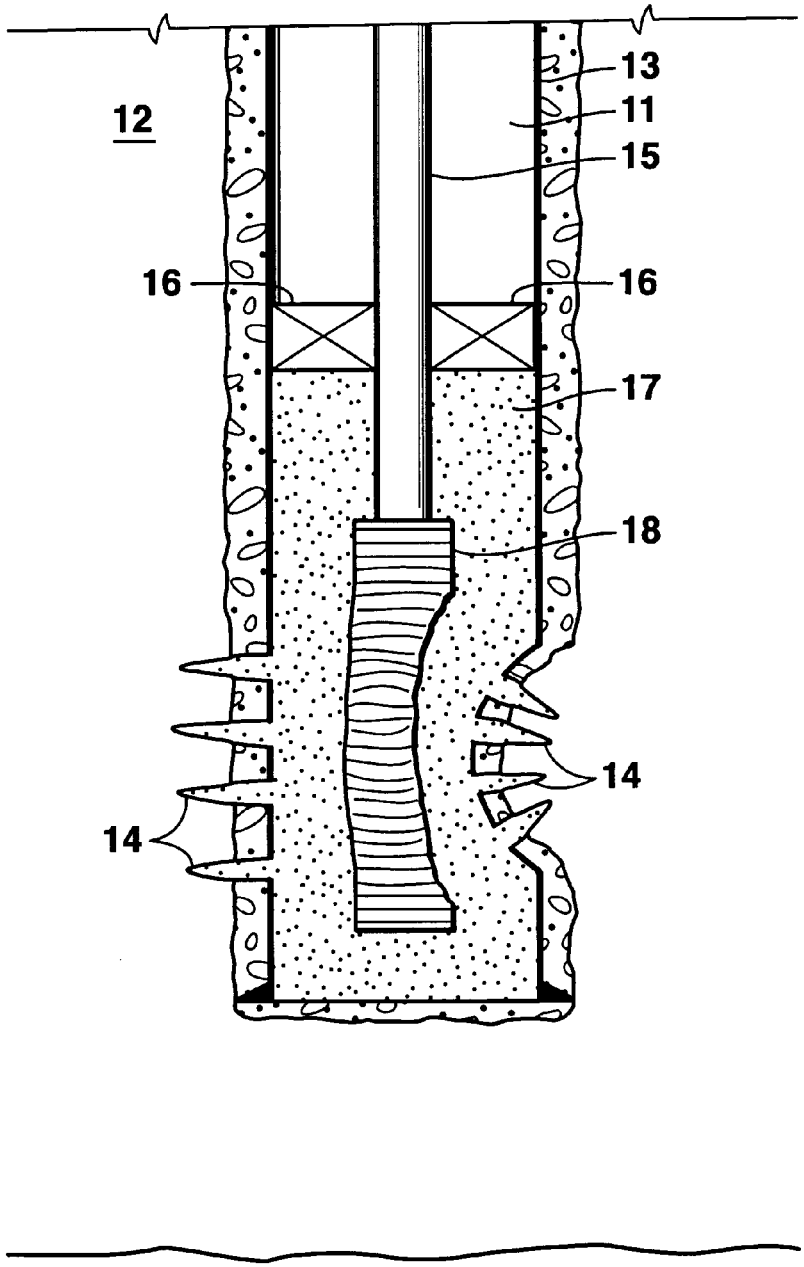
FIG. 1 is an illustration of a cased-hole completion, depicting the destructive impact of the reservoir compaction forces transmitted by a conventional gravel pack.

Referring more particularly to the drawings, FIG. 1 illustrates a conventional gravel pack completion in a cased well. Wellbore 11 extends from the surface (not shown) and into or through formation 12. The wellbore 11 shown is cased with casing 13 having perforations 14 therethrough, as will be understood in the art. While wellbore 11 is illustrated as being a substantially vertical, cased well, it should be recognized that the present invention can be used equally as well in "open hole" and/or under-reamed completions as well as in horizontal and/or inclined wellbores. The wellbore 11 includes production tubing 15 and a packer 16 to isolate a completion annulus 17, and sand screen 18. The completion annulus 17 is shown filled with conventional gravel or sand.

Figure 2:
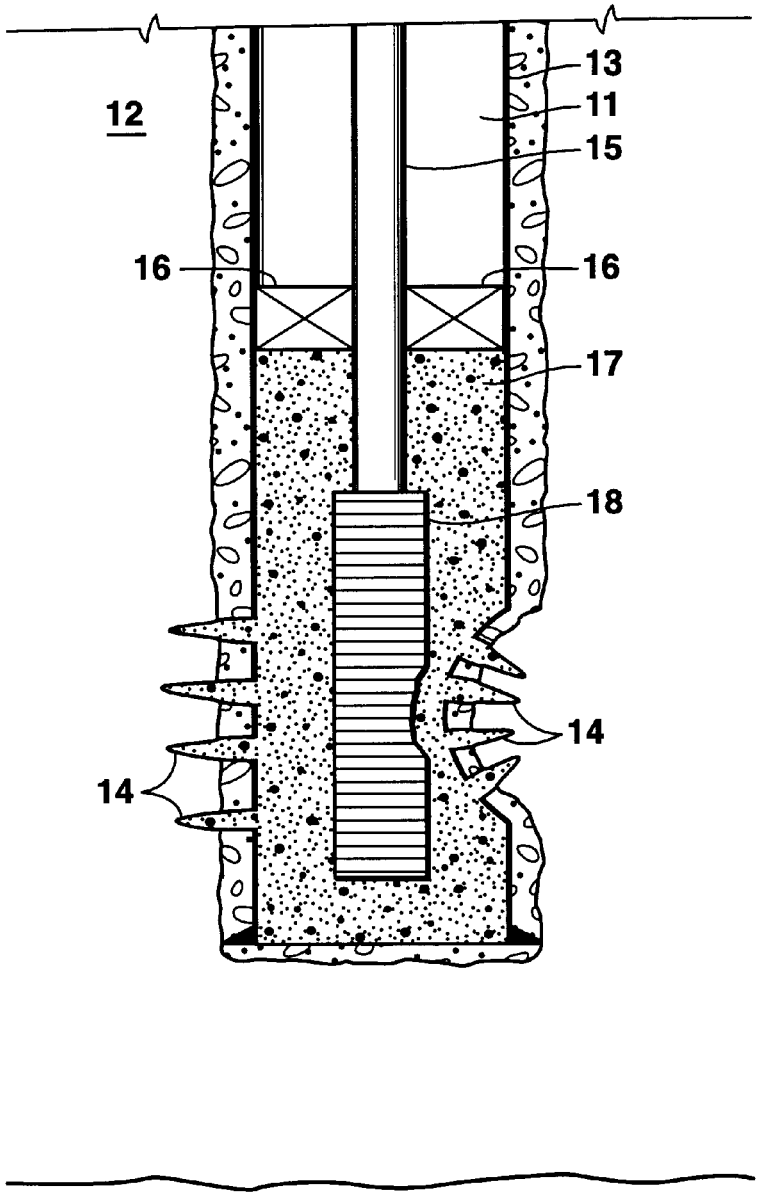
FIG. 2 is an illustration of a cased-hole completion, depicting the resilience of a gravel pack of the invention when impacted by similar reservoir compaction forces.

FIG. 1 also illustrates the damage that occurs in sand screen 18 when the wellbore 11 is damaged by external forces in the reservoir formation. FIG. 2 shows the same equipment with little or no damage from the same or similar external forces in the reservoir formation. In FIG. 2, the completion annulus 17 is shown filled with a mixture of conventional gravel and a deformable material.

In one embodiment, the invention is a gravel pack completion wherein the gravel employed is a mixture of conventional gravel and one or more solid deformable materials. In another embodiment, the invention is a method that utilizes deformable gravel pack materials in combination with conventional gravel to control production of formation sand while at the same time postponing or eliminating wellbore damage caused by reservoir compaction, subsidence, or collapse. The deformable property of the gravel pack of the invention allows the gravel pack to alter shape and/or volume under externally-applied loads (due to moving formations), so as to transfer a reduced amount of those forces to the wellbore completion equipment.

The word "deformable" will be used herein to refer to solid materials that are flexible, compressible, or crushable. Conventional gravels are relatively hard, non-elastic, and not easily deformed. Substitution or addition of a material that is elastically flexible, plastically compressible, or crushable will reduce the load transfer from the formation to the wellbore. An elastically flexible material will deform and take on a different shape when it is subjected to an applied load. When the load is removed, the material will regain its original shape. A plastically compressible material will deform and take on a different shape when subjected to an applied force. When the force is removed, the deformed material will not return to its original shape but will retain some amount of permanent deformation. A crushable gravel pack gravel would be designed to crush when it is subjected to a certain amount of applied force.

In one embodiment of the invention, conventional gravel is intermixed with the deformable material to form a gravel pack that will reduce the load transfer from the formation to the completion equipment in the wellbore. The preferred amount of deformable material in the mixture could vary between a small amount sufficient to provide a beneficial effect and 100 percent (by weight or by volume). It is preferable for the two materials to have a similar particle size and bulk density, and on this basis, the relative proportions of the two materials would be similar on either a volume basis or a weight basis. Actual amounts used will depend on the load-absorbing requirements of a particular application, as well as upon the properties of the deformable material and conventional gravel employed.

In general, the overall compressive stiffness of the mixture in a gravel pack would preferably be from about 33% to about 67% of the compressive stiffness of conventional gravel alone, more preferably from about 33% to about 50% of the compressive stiffness of conventional gravel alone. Varying the type of deformable material (among those of greater or lesser resistance) or varying the proportions of deformable material and conventional gravel in the gravel pack will result in a gravel pack with the desired properties. If a large percentage of the mixture is deformable material and a large percentage of this deformable material is deformed, problems may be encountered with corresponding reductions in the permeability of the gravel pack to liquid or gas flow. If a large percentage of the mixture is crushable, the generation of fine crushed material may make the gravel pack more prone to plugging problems, thereby reducing permeability. Special coatings or materials added to the crushable material could be used to reduce the tendency of fines to plug the gravel pack as fluids flow through the gravel pack.

It is anticipated that the most preferred combinations would contain from about 10% to about 50% deformable material by weight, with from about 15% to about 30% by weight being even more preferred, and about 20% by weight being most preferred. The deformable material could be incorporated into the gravel mixture by adding particles of such material, by using an elastically flexible or plastically deformable material as one or more layers of a coating on a substantially non-deformable core, or by combining an aggregate of deformable material(s) and substantially non-deformable material(s) within each particle. Percentage mixtures of materials referenced herein refer to any of the above physical combinations unless otherwise noted.

Deformable materials (with or without coatings) having the properties desired for this invention would include materials such as polymer beads or granules that would deform or crush under a few thousand pounds per square inch (10 to 50 MPa) of load. For the elastically and plastically deformable materials, foams, cellular solids, solid or foamed polymers, and other plastics with sufficient resistance to wellbore pressure and temperature conditions would all be possible candidates for use either as a particle or as a coating around a core of a substantially non-deformable material. Such solid polymers may include polymer blends and alloys (optionally including fillers), and shell-core graft copolymers, in pelletized, granular, or similar forms. Substantially non-deformable materials suitable for use as a core would include, but not be limited to, conventional gravels as well as some synthetic organic particles, inorganic or mineral particles, metal beads, and glass beads. Hollow glass or ceramic beads would be useful as a crushable material, but may generate undesirable fines. Polymer coatings could provide some elastic and/or plastic deformation, and hold shattered bead fragments together, and to minimize the amount of small plugging fines produced from bead crushing. A preferred deformable material for use in combination with conventional gravel is BJ Services' FlexSand™ fracture proppant and similar materials described in U.S. Pat. No. 6,059,034.

Choosing gravel pack gravel with relatively low bulk stiffness for mixture with the deformable material may be beneficial, possibly reducing the quantity of deformable material required for a given application. It is preferable for the materials combined in the gravel pack to have similar shape, particle size, and bulk density to maximize sand filtration effectiveness. This will enhance mixing of the materials, and ensure the materials do not stratify during installation of the gravel pack in the wellbore. Also, the deformable material must be stable under downhole conditions (temperature and pressure) and resistant to the fluids the material will encounter there. The deformable material may be in pellet, granule, or particle form (possibly ground) with an average particle size of from about 10 to about 150 mesh size on the US Sieve Series. A combination of deformable material with conventional gravel will make a gravel pack completion more resilient to formation movement while at the same time preventing production of formation sand.

It is desirable to have a substantially uniform mixture of the deformable material and conventional gravel installed in the wellbore. The components may be blended together in the initial steps of preparing the gravel pack (at the surface), or combined in the wellbore as part of the installation process. The deformable particles would have enough toughness to minimize damage to the particles as they go through the gravel pack pump and piping. For materials with similar particle size and bulk density, the relative proportions of the two materials may be measured on either a volume basis or a weight basis. With such a material, installation of the gravel pack of the invention would be essentially the same as for a standard gravel pack job.

The proposed invention utilizes a mixture of conventional gravel and deformable materials as gravel pack gravel to cushion the wellbore tubulars in a region of reservoir formation movement or collapse. The reduced load transfer to the completion equipment is anticipated to be capable of at least doubling the life of completion equipment in reservoir formations where compaction or other movement is a problem. Load carrying capacity is typically not considered in the design of gravel packs or selection of gravel pack gravel. This is because in typical gravel pack wells, any mechanical load imparted to the gravel pack gravel is insignificant when compared with the load carrying capacity of the gravel and completion equipment (to which gravel loads are imparted). By combining or replacing conventional gravel with the deformable materials of this invention, a gravel pack can deform without imparting damaging loads to the completion equipment, and wellbore damage may be delayed.

In an alternative embodiment of the invention, the annular space that is filled with the deformable solid material is maximized. Specifically, the annular gap between the completion equipment (typically the gravel pack screen) and the casing inside diameter (or hole diameter for an open-hole completion) would be maximized. The cushioning effects of the deformable solid material are increased by maximizing this annular gravel pack gravel space. As an example, this maximization of annular space can be achieved by employing a larger internal diameter casing, larger diameter hole, and/or smaller outside diameter gravel pack screen or other completion equipment. Although the gravel pack screen base-pipe diameter is normally selected to be the same nominal diameter as the production tubing, a smaller diameter gravel pack screen could be employed in situations where fluid flow would not be unduly restricted by the resulting reduction in flowpath. A tapered shape for the screen with diameter increasing in the direction of flow would allow some benefit of increased annular space while minimizing the flow restriction.

The optimum combination of conventional gravel and deformable solid material may be determined by standard tests known to those skilled in the art. For example, the American Petroleum Institute (API) has published *Recommended Practices For Testing Sand Used In Gravel Packing Operations* (API Recommended Practice 58, December 1995). In most cases, additional testing for mechanical stiffness and permeability at wellbore pressure and temperature conditions, using tests known to those skilled in the art, would be sufficient. These test results would be used to verify the suitability of a given deformable solid material, as well as to identify the optimal mixture of conventional gravel and deformable material. The optimum ratio of deformable material to regular gravel can be determined based on gravel pack stiffness under load for a variety of mixture ratios, and permeability measurements taken for these various mixture ratios while under load. Regardless of the optimal mixture indicated by the test data, the costs and relative benefits of the various materials that could be used to implement this invention may affect the selection of materials and the ratios used for a given wellbore completion.

In general, the stiffness test data would be used to identify the minimum percentage of deformable particles that deliver sufficient stiffness reduction. Although maximum stiffness reduction would generally be achieved with a 100% deformable particle gravel pack, the incremental stiffness reduction with additional deformable material would generally be expected to decline above approximately 50% deformable material. Economic and permeability considerations would also create a preference for lower percentages of deformable material. The permeability data for the selected mixture would preferably be checked to ensure adequate gravel pack permeability at the anticipated wellbore conditions. Reduced risk of wellbore failure may justify use of this method even where reservoir compaction has not been confirmed.

EXPERIMENTAL RESULTS

As previously described, a gravel pack composed of deformable material and conventional gravel can reduce compression loading on the sand screen and other completion equipment, however, the gravel pack must also maintain permeability under stress loading. Uniaxial compaction and permeability tests were conducted to quantify gravel pack stiffness under an imposed load and gravel pack permeability under an imposed load for one type of deformable material mixed with a conventional gravel in a variety of ratios.

The deformable material used was FlexSand, a polymer-based particle containing an inert filler or core that is sold by BJ Services Company. The conventional gravel material used was Econoprop, a lightweight, chemically inert ceramic material sold by Carbo Ceramics, Inc. The specific gravity for FlexSand is in the range of 1.95 to 2.0, while the specific gravity for Econoprop is in the range of 2.66 to 2.72. The FlexSand material was blended at various specified fractions with the similarly-sized Econoprop material. Uniaxial compaction and permeability tests were conducted to quantify stiffness and permeability under various loads for gravel packs containing various amounts of FlexSand deformable material and Econoprop gravel, as measured in weight percent (wt %).

EXAMPLE 1

Uniaxial Compaction Tests

Figure 3:
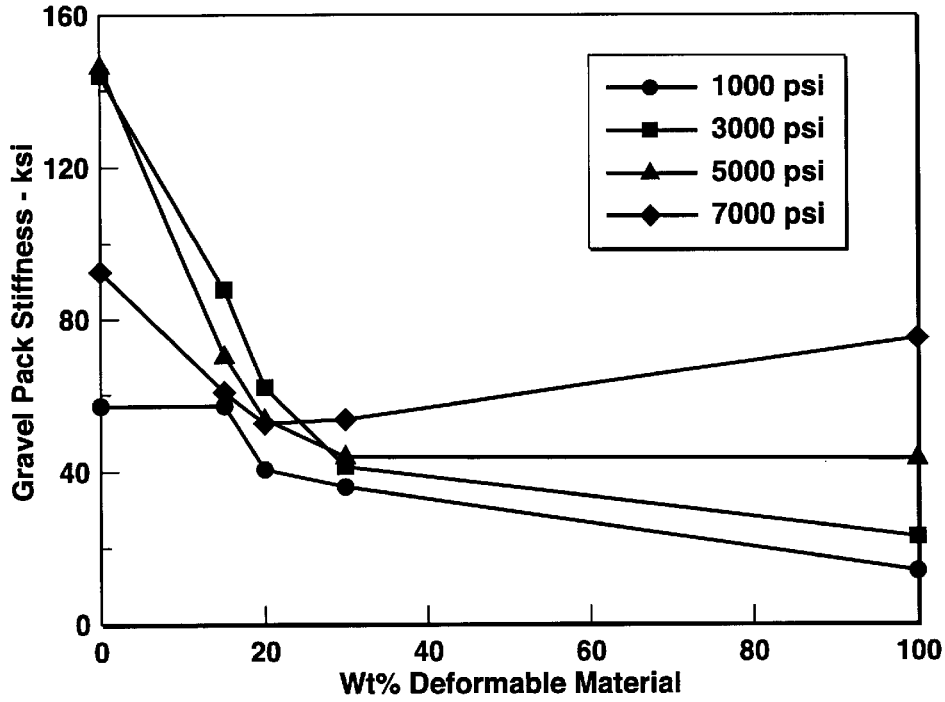
FIG. 3 is a graph showing gravel pack stiffness as a function of weight percent deformable material present in the gravel pack, as described in Example 1.

Uniaxial compaction tests were conducted using a modified API crush resistance cell and load frame based on API Recommended Practice 56 (December 1995). The modifications to the API tests included allowance for stress testing at stresses up to 7000 psi (48.3 MPa). These compaction tests were conducted using 30/40 mesh size FlexSand deformable material combined in various ratios with 30/50 mesh size Econoprop gravel. The tests were conducted at 170° F. (77° C.) and a 4 lbm/ft$^2$ (19.5 kg/m$^2$) loading concentration. The uniaxial stress on the pack was increased at 200 psi/min (1.4 MPa/min). The results of the tests conducted using 0 wt % (comparative), 15 wt %, 20 wt %, 30 wt %, and 100 wt % FlexSand deformable material are shown in FIG. 3 and in Table 1 below.

TABLE 1

Gravel Pack Stiffness Data (30/40 FlexSand mixed with 30/50 Econoprop)

| Applied | Gravel Pack Stiffness in ksi (ksi = 1000 psi) | | | | |
|---|---|---|---|---|---|
| Stress (psi) | 0 wt % FlexSand | 15 wt % FlexSand | 20 wt % FlexSand | 30 wt % FlexSand | 100 wt % FlexSand |
| 1000 | 57.1 | 57.3 | 40.3 | 35.8 | 13.7 |
| 3000 | 143.6 | 87.3 | 61.6 | 41.2 | 22.6 |
| 5000 | 146.4 | 71 | 53.2 | 43.7 | 43.2 |
| 7000 | 92.6 | 60.6 | 52.2 | 53.4 | 75.1 |

The compaction behavior and the stiffness of the gravel pack with increasing stress are influenced by, for example, particle rearrangement, crushing, and deformation. For stresses from 3000 to 7000 psi (20.7 to 48.3 MPa), the increased fraction of deformable material from 0 wt % to 15 wt % significantly reduced the gravel pack stiffness. At 0 wt % deformable material (comparative), the pack stiffness increased with stress to 5000 psi (34.5 MPa) and decreased at 7000 psi (48.3 MPa). At 100 wt % deformable material, the pack stiffness increased with stress to 7000 psi (48.3 MPa). At 20 to 30 wt % deformable material, the pack stiffness remained relatively low, independent of the stress.

EXAMPLE 2

Permeability Tests

Figure 4:
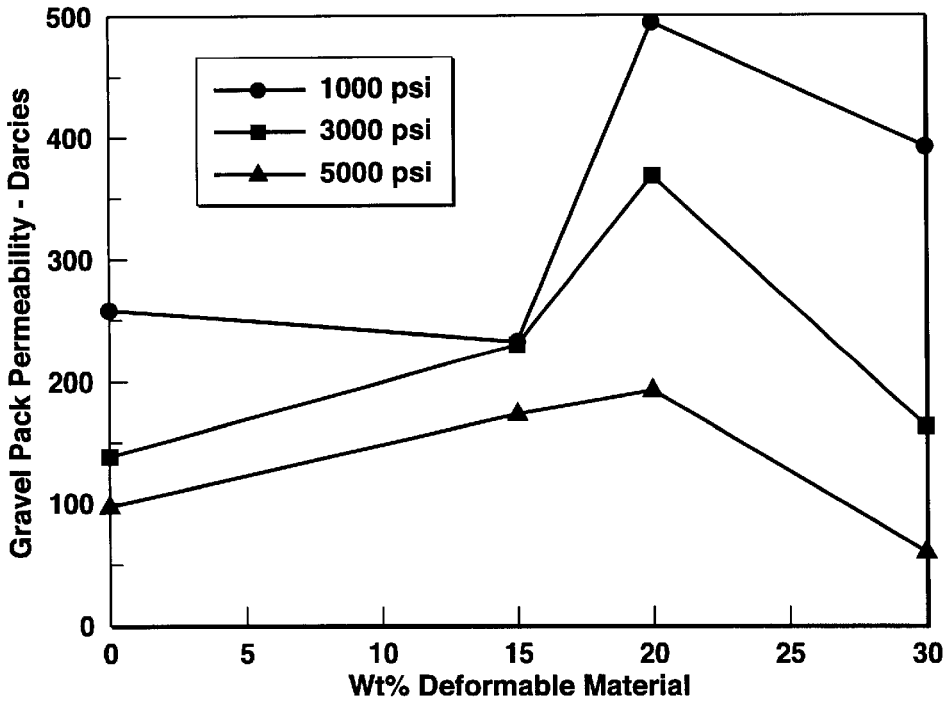
FIG. 4 is a graph showing gravel pack permeability as a function of weight percent deformable material present in the gravel pack, as described in Example 2.

Permeability tests were performed based on API Recommended Practice 61 (October 1989) for conductivity testing, using 30/50 mesh size Econoprop gravel and various amounts of 25/50 mesh size FlexSand deformable material. The tests were conducted at 170° F. (77° C.) and 4 lbm/ft$^2$ (19.5 kg/m$^2$) loading concentration. The stress on the pack was maintained at 1000 psi (6.9 MPa), 3000 psi (20.7 MPa), and 5000 psi (34.5 MPa) for 24 hours, while flowing de-ionized water through the pack. The results of the tests conducted, using 0 wt % (comparative), 15 wt %, 20 wt %, and 30 wt % FlexSand deformable material, are displayed in FIG. 4 and in Table 2 below.

TABLE 2

Gravel Pack Permeability Data (25/50 FlexSand mixed with 30/50 Econoprop)

| | Gravel Pack Permeability (darcies) | | | |
|---|---|---|---|---|
| Applied Stress (psi) | 0 wt % FlexSand | 15 wt % FlexSand | 20 wt % FlexSand | 30 wt % FlexSand |
| 1000 | 256 | 232 | 493 | 390 |
| 3000 | 138 | 229 | 366 | 161 |
| 5000 | 99 | 172 | 192 | 60 |

In general, for each amount of deformable material, the permeability decreases as the stress on the gravel pack increases. Similar to the stiffness results, the permeability behavior of the gravel pack with increasing stress is also influenced by particle rearrangement, crushing, and deformation, and the associated alteration of the gravel pack's pore structure. The highest permeability was achieved with 20 wt % deformable material for each stress level.

SUMMARY OF EXPERIMENTAL RESULTS

The data in FIG. 1 show that gravel pack stiffness reaches a near-minimum value when the percentage of deformable material used is approximately 20 wt % to 30 wt %. Relatively little change in gravel pack stiffness was observed with higher percentages of deformable material in the gravel pack mixture. The data shown in FIG. 2 show a near maximum in permeability when the percentage of deformable material is approximately 20 wt %. For a desired goal of minimum gravel pack stiffness and maximum gravel pack permeability, with these materials, a gravel pack with 20 wt % deformable material and 80 wt % conventional gravel is optimum.

In addition to maintaining permeability in the gravel pack, to allow production of oil and gas, the gravel pack must also continue to serve its sand control function. A mixture of 20 wt % 25/50 mesh size FlexSand deformable material (particle diameters ranging from 710 $\mu$m to 297 $\mu$m) and 80 wt % 30/50 mesh size Econoprop gravel (particle diameters ranging from 589 $\mu$m to 297 $\mu$m) will have a larger median particle diameter and pore size than 30/50 mesh size gravel. Using well-sieved gravel, the mixture would essentially be composed of FlexSand and Econoprop particles with diameters ranging from 589 $\mu$m to 297 $\mu$m and a minority of larger FlexSand particles with diameters ranging from 710 $\mu$m to 589 $\mu$m. Assuming a linear distribution of particle sizes in the 25/50 mesh size FlexSand and 30/50 mesh size Econoprop, the mixture would contain only 6 wt % larger FlexSand particles. Since the fraction of larger particles added to the mixture is small, the increased median pore size as compared to 30/50 mesh size gravel should not have much effect on the sand control properties of the gravel pack Criteria for selection of deformable materials to be used as substitutes for conventional gravels have been provided, and those skilled in the art will recognize that many materials not specifically mentioned will be equivalent in function for the purposes of this invention. The present invention has been described in connection with its preferred embodiments. However, to the extent that the above description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

What we claim is:

1. A method for forming a gravel pack in a wellbore penetrating a subterranean formation, said method comprising the steps of:

creating a gravel pack mixture using a solid deformable material and a conventional gravel; and placing such gravel pack mixture in said wellbore.

2. The method of claim 1 wherein the gravel pack contains from 10% to 50% by weight of solid deformable material and from 50% to 90% by weight of conventional gravel.

3. The method of claim 2 wherein the solid deformable material is an elastically flexible or plastically compressible material.

4. The method of claim 3 wherein the gravel pack contains from 15% to 30% by weight of solid deformable material and from 70% to 85% by weight of conventional gravel.

5. The method of claim 4 wherein the gravel pack contains 20% by weight of solid deformable material and 80% by weight of conventional gravel.

6. The method of claim 3 wherein the solid deformable material is a solid or foamed polymer.

7. The method of claim 3 wherein the solid deformable material is in the form of a particle of a substantially non-deformable material coated with an elastically flexible or plastically compressible material.

8. The method of claim 3 wherein the solid deformable material is in the form of a particle of an elastically flexible or plastically compressible material containing a substantially non-deformable filler.

9. The method of claim 3 wherein the overall compressive stiffness of the gravel pack containing solid deformable material and conventional gravel is 33% to 67% of the stiffness of a gravel pack containing the conventional gravel alone.

10. The method of claim 3 wherein the overall compressive stiffness of the gravel pack containing solid deformable material and conventional gravel is 33% to 50% of the stiffness of a gravel pack containing the conventional gravel alone.

11. The method of claim 1 wherein the gravel pack contains from 10% to 50% by volume of solid deformable material and from 50% to 90% by volume of conventional gravel.

12. The method of claim 11 wherein the solid deformable material is an elastically flexible or plastically compressible material.

13. The method of claim 12 wherein the gravel pack contains from 15% to 30% by volume of solid deformable material and from 70% to 85% by volume of conventional gravel.

14. The method of claim 13 wherein the gravel pack contains 20% by volume of solid deformable material and 80% by volume of conventional gravel.

15. The method of claim 12 wherein the solid deformable material is a solid or foamed polymer.

16. The method of claim 12 wherein the solid deformable material is in the form of a particle of a substantially non-deformable material coated with an elastically flexible or plastically compressible material.

17. The method of claim 12 wherein the solid deformable material is in the form of a particle of an elastically flexible or plastically compressible material containing a substantially non-deformable filler.

18. A gravel pack for a wellbore penetrating a subterranean formation, said gravel pack containing a mixture of a solid deformable material and a conventional gravel.

19. The gravel pack of claim 18 wherein the gravel pack contains from 10% to 50% by weight of solid deformable material and from 50% to 90% by weight of conventional gravel.

20. The gravel pack of claim 18 wherein the gravel pack contains from 15% to 30% by weight of solid deformable material and from 70% to 85% by weight of conventional gravel.

* * * * *